US005761752A

United States Patent [19]

Blake

[11] Patent Number: 5,761,752

[45] Date of Patent: Jun. 9, 1998

[54] SOAP SHIELD

[76] Inventor: Angelo E. Blake, 13765 56th Ave. South #C401, Seattle, Wash. 98168

[21] Appl. No.: 751,778

[22] Filed: Nov. 6, 1996

[51] Int. Cl.[6] ..... A47K 3/00

[52] U.S. Cl. ..... 4/559; 4/605

[58] Field of Search ..... 4/559, 628, 605; 312/245, 242; 200/333, 432.2; 220/241, 242

[56] References Cited

U.S. PATENT DOCUMENTS

| | | | |
|---|---|---|---|
| 4,102,466 | 7/1978 | Jadatz | 220/242 |
| 4,300,248 | 11/1981 | Dworkin | 4/559 |
| 4,709,428 | 12/1987 | Garcia | 4/605 |
| 4,979,634 | 12/1990 | Begley | 220/242 |
| 5,509,529 | 4/1996 | Kelly | 4/628 |
| 5,533,637 | 7/1996 | Williams, Jr. | 220/242 |

*Primary Examiner*—David J. Walczak

[57] ABSTRACT

A new Soap Shield for protecting soap within various sizes of wall mounted soap dishes from water or debris build up while allowing easy access to the soap within, thereby preventing dissolving of the soap. The inventive device includes a cover member which is pan shaped with a narrow end open and a rectangular aperture along the bottom of the cover member, an L-shaped door pivotally secured to the cover member and covering the rectangular aperture, and where the cover member is secured by an adhesive strip to a bath tub wall surrounding the wall mounted soap dish with the rim of the half moon shaped cover member secured to the bath tub wall forming a seal and where the open end of the cover member is positioned on the bottom allowing drainage and dissipation of accumulated water and liquefied soap within the wall mounted soap shield.

16 Claims, 3 Drawing Sheets

SOAP SHIELD

BACKGROUND OF THE INVENTION

1. Field of the Invention

The present invention relates to Soap Cover Devices and more particularly pertains to a new Soap Shield for protecting soap within various sizes of wall mounted soap dishes from water or debris build up while allowing easy access to the soap within, thereby preventing dissolving of the soap.

2. Description of the Prior Art

The use of Soap Cover Devices is known in the prior art. More specifically, Soap Cover Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Soap Cover Devices include U.S. Pat. No. 4,654,901; U.S. Pat. No. 4,300,248; U.S. Design Pat. No. 283,576; U.S. Pat. No. 4,938,346; U.S. Pat. No. 4,934,640 and U.S. Design Pat. No. 267,527.

While these devices fulfill their respective, particular objectives and requirements, the aforementioned patents do not disclose a new Soap Shield. The inventive device includes a cover member which is pan shaped with a narrow end open and a rectangular aperture along the bottom of the cover member, an L-shaped door pivotally secured to the cover member and covering the rectangular aperture, and where the cover member is secured by an adhesive strip to a bath tub wall surrounding the wall mounted soap dish with the rim of the half moon shaped cover member secured to the bath tub wall forming a seal and where the open end of the cover member is positioned on the bottom allowing drainage and dissipation of accumulated water and liquefied soap within the wall mounted soap shield.

In these respects, the Soap Shield according to the present invention substantially departs from the conventional concepts and designs of the prior art, and in so doing provides an apparatus primarily developed for the purpose of protecting soap within various sizes of wall mounted soap dishes from water or debris build up while allowing easy access to the soap within, thereby preventing dissolving of the soap.

SUMMARY OF THE INVENTION

In view of the foregoing disadvantages inherent in the known types of Soap Cover Devices now present in the prior art, the present invention provides a new Soap Shield construction wherein the same can be utilized for protecting soap within various sizes of wall mounted soap dishes from water or debris build up while allowing easy access to the soap within, thereby preventing dissolving of the soap.

The general purpose of the present invention, which will be described subsequently in greater detail, is to provide a new Soap Shield apparatus and method which has many of the advantages of the Soap Cover Devices mentioned heretofore and many novel features that result in a new Soap Shield which is not anticipated, rendered obvious, suggested, or even implied by any of the prior art Soap Cover Devices, either alone or in any combination thereof.

To attain this, the present invention generally comprises a cover member which is pan shaped with a narrow end open and a rectangular aperture along the bottom of the cover member, an L-shaped door pivotally secured to the cover member and covering the rectangular aperture, and where the cover member is secured by an adhesive strip to a bath tub wall surrounding the wall mounted soap dish with the rim of the half moon shaped cover member secured to the bath tub wall forming a seal and where the open end of the cover member is positioned on the bottom allowing drainage and dissipation of accumulated water and liquefied soap within the wall mounted soap shield.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Soap Shield apparatus and method which has many of the advantages of the Soap Cover Devices mentioned heretofore and many novel features that result in a new Soap Shield which is not anticipated, rendered obvious, suggested, or even implied by any of the prior art Soap Cover Devices, either alone or in any combination thereof.

It is another object of the present invention to provide a new Soap Shield which may be easily and efficiently manufactured and marketed.

It is a further object of the present invention to provide a new Soap Shield which is of a durable and reliable construction.

An even further object of the present invention is to provide a new Soap Shield which is susceptible of a low cost of manufacture with regard to both materials and labor, and which accordingly is then susceptible of low prices of sale to the consuming public, thereby making such Soap Shield economically available to the buying public.

Still yet another object of the present invention is to provide a new Soap Shield which provides in the apparatuses and methods of the prior art some of the advantages thereof, while simultaneously overcoming some of the disadvantages normally associated therewith.

Still another object of the present invention is to provide a new Soap Shield for protecting soap within various sizes of wall mounted soap dishes from water or debris build up while allowing easy access to the soap within, thereby preventing dissolving of the soap.

Yet another object of the present invention is to provide a new Soap Shield which includes a cover member which is pan shaped with a narrow end open and a rectangular aperture along the bottom of the cover member, an L-shaped door pivotally secured to the cover member and covering the rectangular aperture, and where the cover member is secured by an adhesive strip to a bath tub wall surrounding the wall mounted soap dish with the rim of the half moon shaped cover member secured to the bath tub wall forming a seal and where the open end of the cover member is positioned on the bottom allowing drainage and dissipation of accumulated water and liquefied soap within the wall mounted soap shield.

Still yet another object of the present invention is to provide a new Soap Shield where the L-shaped door when in the open position rests on cornice of the cover member.

Even still another object of the present invention is to provide a new Soap Shield that reduces the waste of soap and is easily installed and maintained.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
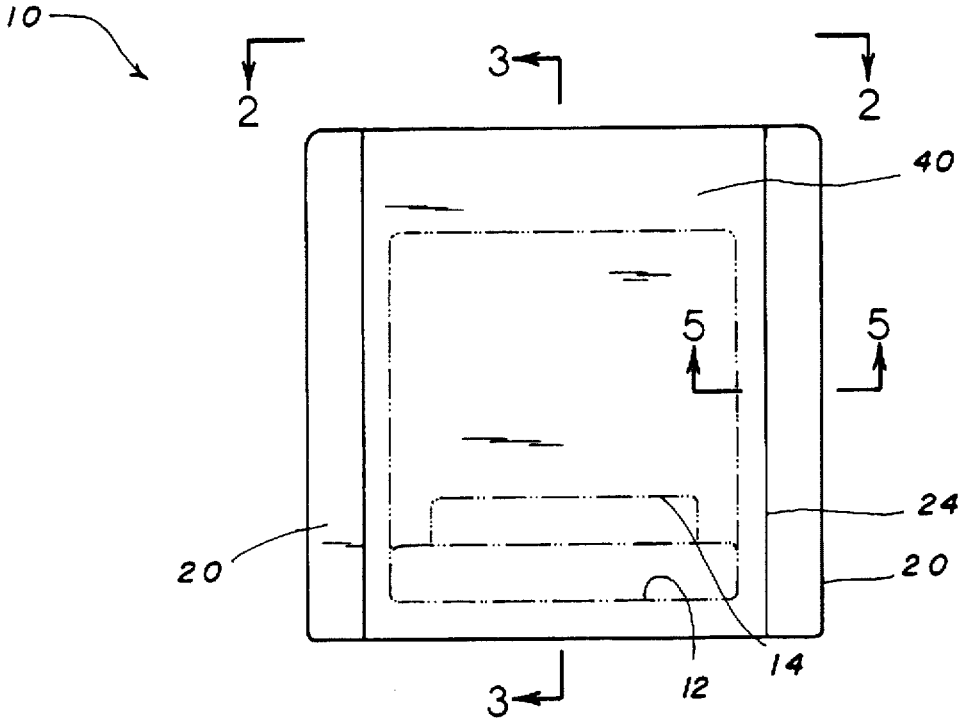
FIG. 1 is a front view of a new Soap Shield according to the present invention.

With reference now to the drawings, and in particular to FIGS. 1 through 7 thereof, a new Soap Shield embodying the principles and concepts of the present invention and generally designated by the reference numeral 10 will be described.

More specifically, it will be noted that the Soap Shield 10 comprises a cover member secured to a bath tub wall and surrounds an existing wall mounted soap dish 12 thereby preventing water or other debris from dissolving soap 14 within the wall mounted soap dish 12, the cover member 20 including a rectangular aperture 24 into the front, and an L-shaped door 40 pivotally secured near the cornice of the cover member 20 and pivotally enclosing the rectangular aperture 24.

Figure 2:
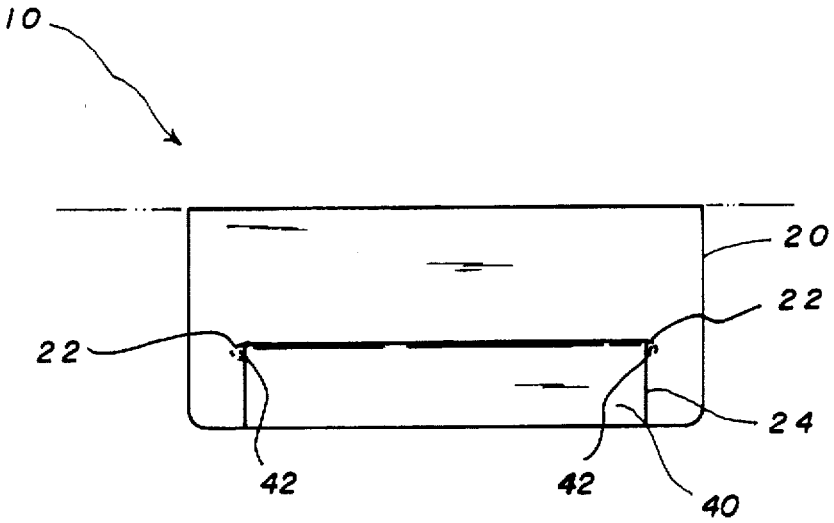
FIG. 2 is a top view thereof taken from the vantage of line 2—2 shown in FIG. 1.
Figure 3:
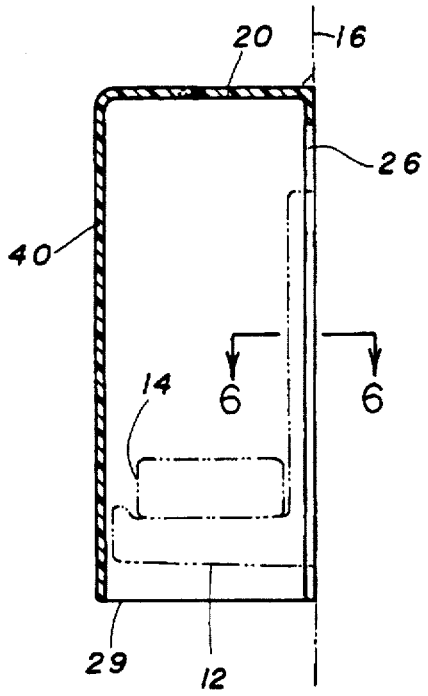
FIG. 3 is a cross sectional view taken along line 3—3 of FIG. 1 displaying the L-shaped door in the closed position.
Figure 4:
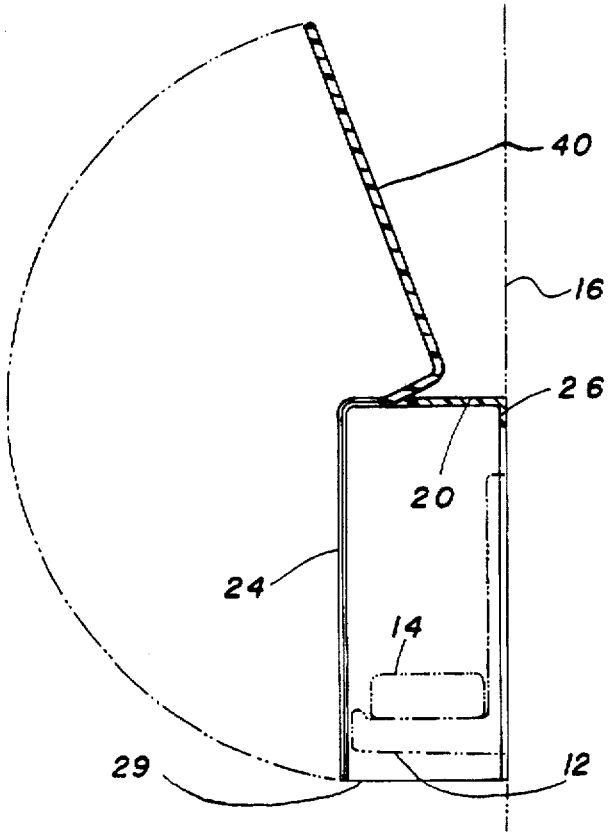
FIG. 4 is a view of FIG. 3 displaying the L-shaped door in the closed position.
Figure 5:
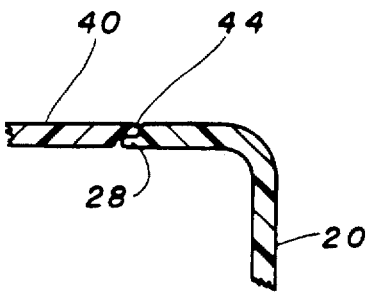
FIG. 5 is a cross sectional view taken along line 5—5 of FIG. 1.
Figure 6:
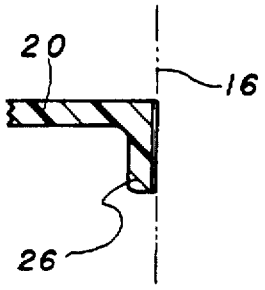
FIG. 6 is a cross sectional view taken along line 6—6 of FIG. 3.
Figure 7:
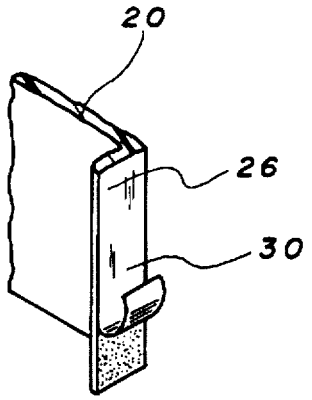
FIG. 7 is a rear perspective view of the flange juxtaposed to the adhesive strip.

As best illustrated in FIGS. 1 through 4, it can be shown that the cover member 20 is formed into a rectangular pan shape with the rim secured to the bath tub wall 16. As best shown in FIG. 2 of the drawings, the rectangular aperture 24 extends from the bottom edge of the cover member 20 to the cornice and projecting back through the cornice a finite distance. The cover member 20 has a pivot cavity 22 into each side of the interior edge of the rectangular aperture 24 near the cornice. The L-shaped door 40 has two axle pins 42 secured to the opposite edges of the cornice. The axle pins 42 are pivotally captured by the pivot cavities 22 as shown in FIGS. 1 and 2 of the drawings. The rim of the cover member 20 has a flange 26 projecting inward as best shown in FIG. 6 of the drawings. The flange 26 is secured to the bath tub wall 16 to increase the surface contact area thereby increasing strength and impermeability. As shown in FIG. 7, an adhesive strip 30 is preferably positioned mesial the flange 26 and the bath tub wall securing the cover member 20 to the bath tub wall and forming an impermeable seal. As best shown in FIG. 5 of the drawings, the cover member 20 has a cover aperture lip 28 extending outwardly towards the center from the edge of the rectangular aperture 24 parallel to the interior surface of the cover member 20. As best shown in FIG. 5 of the drawings, the L-shaped door 40 has a door lip 44 along the left and right sides extending outwardly from the center parallel to the exterior surface of the L-shaped member. As shown in FIG. 5, the door lip 44 preferably overlaps with the cover aperture lip 28 when the L-shaped door 40 is in the closed position to form an impermeable seal. The cover member 20 preferably has a drainage opening 29 in the bottom surface allowing dissipation and drainage of water or liquefied soap within the wall mounted soap dish 12. The cover member 20 and the L-shaped door 40 preferably are constructed from a rigid transparent plastic.

In use, the rim of the cover member 20 is secured to the bath tub wall 16 surrounding the wall mounted soap dish 12. During a shower or a bath, the user simply pivots the L-shaped door 40 so as to pass the upper vertical plane to rest against the bath tub wall 16 thereby preventing the L-shaped door 40 from closing during removal of the soap 14. The user extends his hand in through the exposed rectangular aperture 24 and grasps the soap 14 from within. After removing the soap 14, the user manipulates the L-shaped door 40 to be positioned into the closed position thereby preventing water from accumulating within the wall mounted soap dish 12. When the user is finished utilizing the soap 14, the user repeats the above procedure except to replace the soap 14 back upon the wall mounted soap dish 12 where the soap 14 is protected from water or other debris. During and after the shower, any water that may seep into the interior portion of the present invention simply descends downwardly through the drainage opening 29. Further, any water that has accumulated onto the wall mounted soap dish 12 may dissipate through the drainage opening 29 allowing ventilation and the dissipation of any water storage within the soap 14 is allowed to provide a solidified soap 14 for the next bath or shower and preventing the accumulation of liquefied soap build up.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soap dish shield comprising:

a cover member adapted to be secured to a bath tub wall and positioned to surround an existing wall mounted soap dish for preventing water or other debris from dissolving soap stored in the wall mounted soap dish;

the cover member having a front and a top, said cover member having a substantially rectangular aperture formed in the front thereof; and an L-shaped door pivotally secured near the top of the cover member for pivotally closing the rectangular aperture;

wherein the cover member includes a drainage opening in the cover member opposite the top for permitting drainage of liquid from the cover member.

2. The soap dish shield of claim 1 wherein the cover member is formed into a rectangular pan shape having a rear rim for securing to a bath tub wall.

3. The soap dish shield of claim 2 wherein the cover member has a bottom edge opposite the top of the cover member, and wherein the rectangular aperture extends from the bottom edge of the cover member to the top of the cover member and projects back through the top of the cover member a finite distance.

4. The soap dish shield of claim 3 wherein the rectangular aperture is defined by an interior edge, and wherein the cover member includes a pivot cavity formed in each side of the interior edge of the rectangular aperture near the top of the cover member.

5. The soap dish shield of claim 4 wherein the L-shaped door includes two axle pins pivotally captured by the pivot cavities to secure the L-shaped door to each side of the interior edge of the rectangular aperture.

6. The soap dish shield of claim 5 wherein the rear rim of the cover member includes a flange projecting inwardly for securing to a bath tub wall.

7. The soap dish shield of claim 6 wherein an adhesive strip is mounted on the flange for positioning between the flange and a bath tub wall for forming a substantially impermeable seal therebetween.

8. The soap dish shield of claim 7 wherein the cover member includes a cover aperture lip extending along and outwardly from the interior edge of the rectangular aperture towards the center of the rectangular aperture.

9. The soap dish shield of claim 8 wherein the L-shaped door has a perimeter edge with laterally spaced left and right side edges, said left and right side edges having a door lip thereon extending laterally outwardly from the center of the L-shaped member, wherein the door lip overlaps the cover aperture lip when the L-shaped door is located in a closed position where the L-shaped door closes the rectangular aperture of the cover member.

10. A soap dish shield comprising:

a cover member adapted to be secured to a bath tub wall and positioned to surround an existing wall mounted soap dish for preventing water or other debris from dissolving soap stored in the wall mounted soap dish;

the cover member having a front and a top and including a substantially rectangular aperture formed in the front of said cover member; and an L-shaped door pivotally secured near the top of the cover member for pivotally closing the rectangular aperture, wherein the cover member is formed into a rectangular pan shape having a rear rim for securing to a bath tub wall, wherein the cover member has a bottom edge opposite the top of the cover member, wherein the rectangular aperture extends from the bottom edge of the cover member to the top of the cover member and projects back through the top of the cover member a finite distance, wherein the rectangular aperture is defined by an interior edge, and wherein the cover member includes a pivot cavity formed in each side of the interior edge of the rectangular aperture near the top of the cover member, wherein the L-shaped door includes two axle pins pivotally captured by the pivot cavities to secure the L-shaped door to each side of the interior edge of the rectangular aperture, wherein the rear rim of the cover member includes a flange projecting inwardly for securing to a bath tub wall, wherein an adhesive strip is mounted on the flange for positioning between the flange and a bath tub wall for forming a substantially impermeable seal therebetween, wherein the cover member includes a cover aperture lip extending along and outwardly from the interior edge of the rectangular aperture towards the center of the rectangular aperture, wherein the L-shaped door has a perimeter edge with laterally spaced left and right side edges, said left and right side edges having a door lip thereon extending laterally outwardly from the center of the L-shaped member, wherein the door lip overlaps the cover aperture lip when the L-shaped door is located in a closed position where the L-shaped door closes the rectangular aperture of the cover member, and wherein the cover member includes a drainage opening in the bottom of said cover member allowing dissipation and drainage of water or liquefied soap from within the wall mounted soap dish.

11. The soap dish shield of claim 10 wherein the cover member and the L-shaped door comprise a rigid plastic.

12. The soap dish shield of claim 11 wherein the cover member and the L-shaped door comprise a transparent rigid plastic.

13. The soap dish shield of claim 1 wherein the cover member comprises a front wall and laterally spaced side walls attached to said front wall, said front and side walls each having a lower edge with the lower edges of said front and side walls define the drainage opening in said cover member.

14. The soap dish shield of claim 1 wherein the cover member has no generally horizontal surfaces located below the top of said cover member.

15. The soap dish shield of claim 1 wherein the cover member and the L-shaped door comprise a rigid plastic.

16. The soap dish shield of claim 1 wherein the cover member and the L-shaped door comprise a transparent rigid plastic.

* * * * *